US006908017B2

(12) United States Patent
Mineau et al.

(10) Patent No.: US 6,908,017 B2
(45) Date of Patent: Jun. 21, 2005

(54) AEROSOL OVER CAP WITH FLIP-UP CLOSURE

(75) Inventors: Steven B. Mineau, Waterford, WI (US); Gary T. Lancina, Shorewood, WI (US); William G. Madala, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 58 days.

(21) Appl. No.: 10/455,667

(22) Filed: Jun. 5, 2003

(65) Prior Publication Data

US 2004/0245294 A1 Dec. 9, 2004

(51) Int. Cl.[7] ..... B65D 83/14

(52) U.S. Cl. ..... 222/402.13; 222/148; 222/402.12; 222/402.1; 222/571

(58) Field of Search ..... 222/108, 148, 222/182, 402.11–402.13, 402.1, 409, 470, 571

(56) References Cited

U.S. PATENT DOCUMENTS

| | | | | | |
|---|---|---|---|---|---|
| 2,982,448 | A | | 5/1961 | Leonard et al. | |
| 3,154,224 | A | | 10/1964 | Wakeman | |
| 3,323,695 | A | * | 6/1967 | Monahon | 222/506 |
| 3,469,746 | A | * | 9/1969 | Melocchi | 222/182 |
| 3,510,029 | A | | 5/1970 | Doyle | |
| 3,642,179 | A | | 2/1972 | Micallef | |
| D316,675 | S | | 5/1991 | Cramer | |
| 5,105,988 | A | | 4/1992 | Knickerbocker | |
| 6,405,898 | B1 | | 6/2002 | O'Connor et al. | |

* cited by examiner

*Primary Examiner*—J. Casimer Jacyna

(57) ABSTRACT

Disclosed are actuator over caps suitable for use with aerosol containers. The caps are provided with flip-down lids that can move from a first position that blocks the outlet to prevent product drool between uses, to a second position that does not block dispensing. A push button is linked by a living hinge to a top wall of the cap. Downward pressure on the button can drive the lid away from its blocking position to facilitate opening the outlet of the cap.

15 Claims, 5 Drawing Sheets

AEROSOL OVER CAP WITH FLIP-UP CLOSURE

CROSS-REFERENCE TO RELATED APPLICATIONS

Not applicable

STATEMENT REGARDING FEDERALLY SPONSORED RESEARCH/DEVELOPMENT

Not applicable

FIELD OF THE INVENTION

This invention relates to aerosol containers for dispensing pressurized materials. More particularly, it relates to actuator caps for such containers where the caps are provided with lids that prevent product "drool"from oozing out of the cap outlet between uses.

BACKGROUND OF THE INVENTION

A variety of products are dispensed from aerosol containers. While many of these products are delivered as fine mists or sprays, some are delivered as foams or gels, particularly shaving products and hair mousses. Such foams or gels typically expand when exposed to air. When such products are dispensed using a conventional aerosol container and actuator cap, a small amount of product may remain in the cap's outlet conduit after the dispensing, downstream of the can valve. This residual product then slowly expands between uses, often creating an unsightly "drool" from the end of the outlet.

Some actuator caps have been provided with pivotable lids (e.g. a lid connected by a living hinge to the main cap). The lids could be swung in front of, and sometimes into, the aerosol outlet, to plug or otherwise close off the outlet between uses. See e.g. U.S. Pat. Nos. D316,675, 2,982,448, and 3,510,029. This reduced the incidence of drool, and provided the consumer with an additional sense of security regarding the integrity of the product about to be delivered.

However, such flip-down lids either required an unsightly projection for the consumer to grip onto (in order to move the lid from the blocking position), or required a finger nail or tool to be used to pry the lid open. This frustrated the ability of the assembly to be a self-contained structure and/or created an unsightly design, and/or created a risk that the consumer's finger nail might break, and/or created a problem for the stackability of the designs (e.g. on a retailer's shelf).

Other approaches have been tried to close the outlet of aerosol caps. See e.g. U.S. Pat. Nos. 3,642,179, 5,105,988 and 6,405,898. However, these structures were complex and unduly costly.

Another concern is that for some types of product delivered from such aerosol containers, some consumers strongly prefer not to have their hands positioned near the outlet of the container when prying a lid off. For example, if the container contains an insecticidal gel consumers might prefer to be able to open the lid without having the consumer's hand near the outlet for the dispensed material. Unfortunately, some prior lid constructions required contact with the lid quite near the outlet in order to pry the lid open.

A need therefore still exists for aerosol caps with anti-drool protection that are inexpensive to manufacture, yet easy for a consumer to use.

SUMMARY OF THE INVENTION

In one aspect the invention provides an actuator cap that is suitable for use with a pressurized container, the container being of the type containing a product to be dispensed. The cap has a housing having a top wall and an outer skirt wall depending downward there from. There is an actuator panel movably linked to a wall of the housing. There is also a receiver linked to the housing which is suitable for receiving product from the container, the receiver being in communication with an outlet of the cap.

A lid is movably linked to the housing to move between a first position blocking the outlet and a second position not blocking the outlet. There is also a driver linked to a wall of the housing that can drive the lid away from the first position.

In one form the receiver is integrally formed with the actuator panel to pivot therewith. In another the driver is integrally formed with the actuator panel to pivot therewith. The actuator panel can project through the top wall of the cap.

In an especially preferred form the receiver has an axial conduit portion and a radial conduit portion, with the lid being pivotably linked to the housing along an essentially horizontal hinge axis. The lid has a vane extending transversely there from adjacent its inward end, and a plug extending transversely there from adjacent its outer end. The plug is surrounded by a tubular extension extending transversely there from adjacent an outer end of the lid. The vane may have a first abutment surface that is generally parallel to the lid, and a second abutment surface that is not generally parallel to the lid.

In another preferred form the outlet is surrounded by a moat, which in turn is surrounded by a tubular structure, and the driver is in the form of a button. The button is pivotably linked to a top wall of the cap along an essentially horizontal hinge axis, and is positioned relative to the lid such that when the lid is in the first position pivoting movement of the button can move the lid away from the first position. Snap means are provided between the lid and the cap to help retain the cap in the first position. Also, the actuator panel can be mounted for pivoting on an essentially horizontal axis such that when the actuator is pivoted downwardly the lid will be pivoted outwardly.

It will be appreciated from the present disclosure that over caps of the present invention facilitate the easy opening of flip-down lids via a push-down button (or other push panel), preferably located at the top of the cap. After some product is dispensed, the flip-down lid can be manually pushed back to its original position so as to replug the outlet of the aerosol cap. Such over caps are designed so that they can be molded as a one-piece structure and are thus extremely inexpensive to produce.

In a further alternative embodiment, a single actuator panel may have one end that triggers the spray, and another end integrally formed with a driver such that a single pivoting motion both pops the lid open and simultaneously starts the dispensing (e.g. due to the triggering end contacting a pivotable receiver structure while the driver contacts the lid). This embodiment might be appropriate for use with a product like a shaving gel.

Alternatively, in another embodiment the lid can be first popped open by one pushing motion at one button/driver, and dispensing is thereafter initiated by a second downward pushing against an actuator panel that pivots separately from the button driver. This might be most appropriate for use with a very expensive product (e.g. a medicinal gel) which is so expensive that the consumer does not mind the double motion required in order to be sure not to waste any.

In any case, as one does not need to pry the flip-down lid away from the outlet using finger nails or a tool in any of the embodiments of the invention, the risk of consumer dissatisfaction from broken nails or inability to easily open the product is avoided. Further, these results are achieved without compromising the security of the anti-drool closure, or requiring a consumer's hand to be placed near the outlet. The outside surface of the cap remains smooth. This therefore permits stackability of the product during storage.

The foregoing and other advantages of the present invention will appear from the following description. In the description reference is made to the accompanying drawings which form a part thereof, and in which there is shown by way of illustration, and not limitation, a preferred embodiment of the invention. This embodiment does not represent the full scope of the invention. Rather, reference should therefore be made to the claims herein for interpreting the scope of the invention.

DETAILED DESCRIPTION OF THE INVENTION

Figure 1:
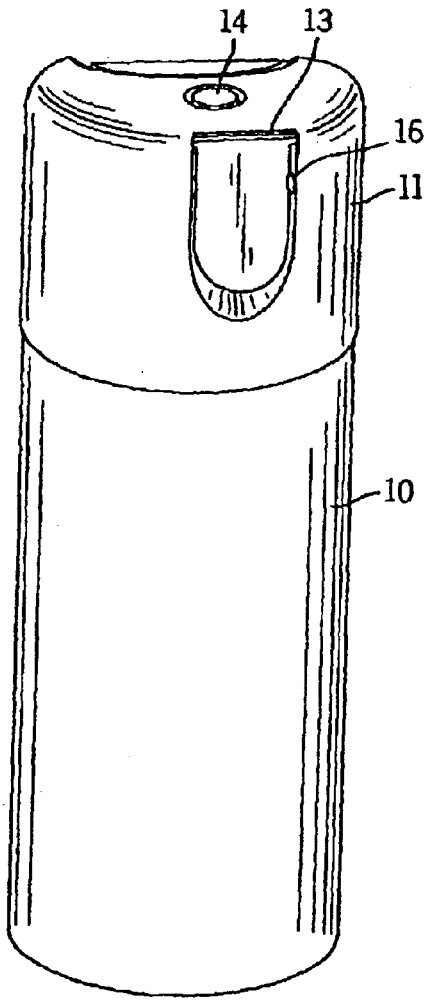
FIG. 1 is a front, left, upper perspective view of a combined aerosol container and over cap, the latter being constructed in accordance with the present invention.
Figure 2:
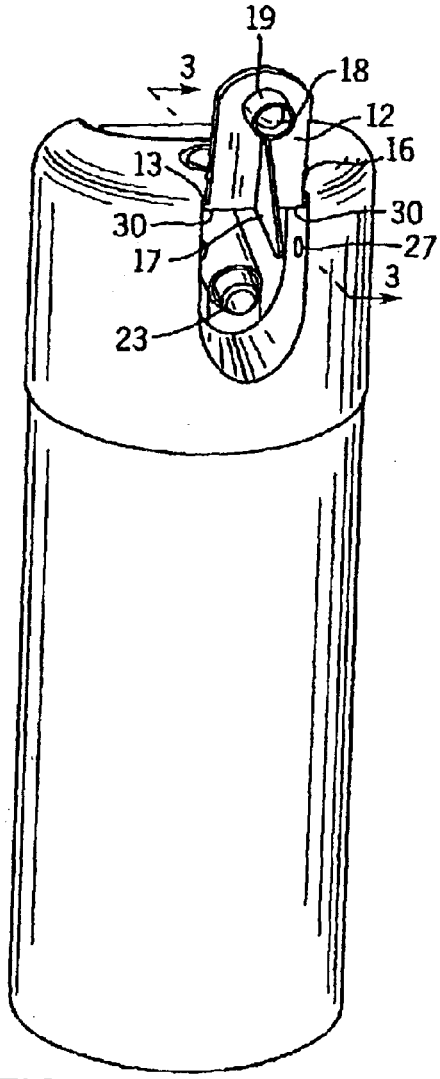
FIG. 2 is a view similar to FIG. 1, but with the flip lid of the present invention shown in the open position.

Referring now to FIGS. 1 and 2, an aerosol can is provided with an over cap 11 to close its upper end. The can preferably contains a gel form shaving cream (e.g. Edge® or Skintimate® shaving gels from S.C. Johnson), or other expandable product.

Such cans are typically provided with an upper valve stem extending out the top of the can (not shown). As is well known in the art, downward or sideward deflection of the valve stem releases product upward from the can.

The over cap 11 of the present invention is provided with a flip-down lid 12 connected by a living hinge 13 to the main cap body. A push button 14 is positioned at the top of the cap and it is also connected by a living hinge 15 to the cap body. Vane 17 is provided on the lid 12, against which the push button 14 can be driven. The lid also has a plug 18 surrounded by a tubular wall 19.

Figure 3:
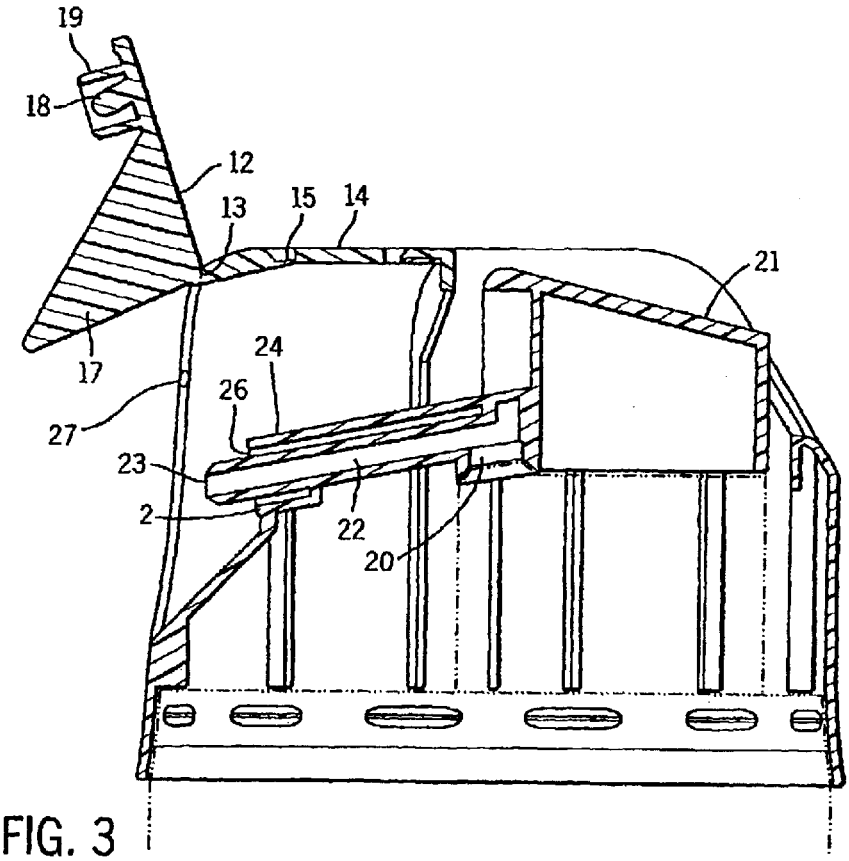
FIG. 3 is a vertical sectional view taken along line 3—3 of FIG. 2.
Figure 4:
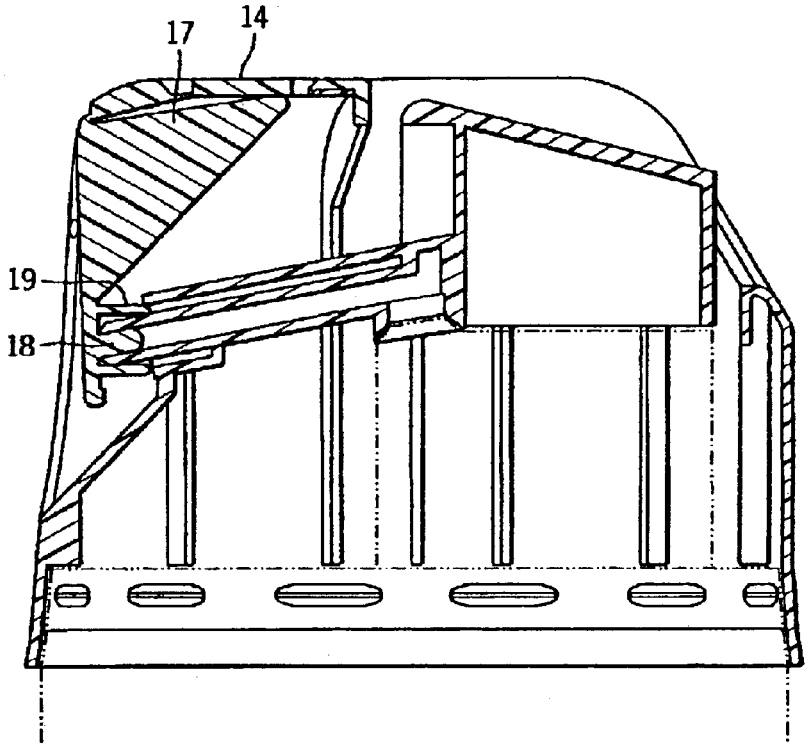
FIG. 4 is a view similar to FIG. 3, but with the lid shown in the closed position.
Figure 5:
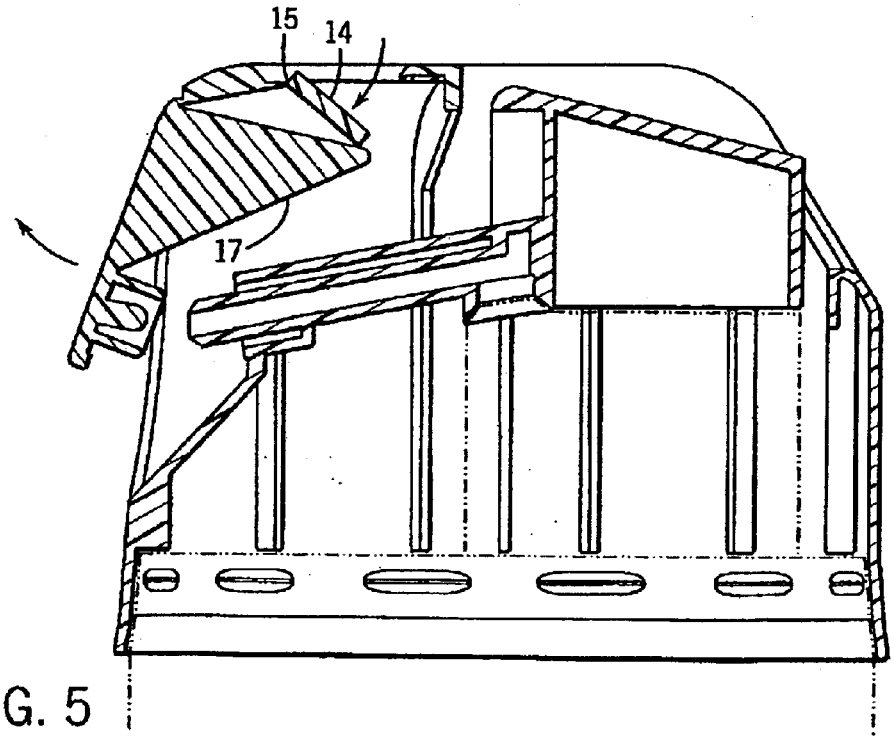
FIG. 5 is another view similar to FIG. 3, but with the top push button shown in the process of being pivoted.

As can best be seen from FIGS. 3–5, the cap of the first embodiment can also be provided with a receiver 20, preferably into which will extend the usual valve stem (not shown). The term "receiver" is used in its functional sense to mean a portion of the device which receives the product being dispensed from the container, and is not intended to require that the valve stem from the container actually fit in the receiver (albeit this is preferred).

An actuator panel 21 can pivot to drive movement of the receiver 20, and thus a valve stem of the container (not shown) to release product first axially upward and then sideways along channel 22 to outlet 23. Surrounding outlet 23 is a further cylindrical structure 24, with a moat 26 there between. As will best be appreciated from FIG. 4, plug 18 is sized to snugly fit in outlet 23, and the outer peripheral end of wall 19 is sized to fit in the moat 26.

Where the cap is made of plastic the plastic can be biased to cause the lid 12 to want to swing to the FIG. 3 "second-"position once the lid leaves the FIG. 4 "first" position. Extensions 16 can be provided along the lateral sides of the lid 12 that would snap past projections 27 to help retain the lid in a closed position. Another set of projections (not shown) could interact with similar projections on the cap to hold the lid in an upward position.

When a consumer buys the FIG. 1 product the cap will be in the FIGS. 1 and 4 configuration. When the consumer wishes to use the product the consumer pushes down on button 14, causing pivoting as shown in FIG. 5. This causes the button 14 to pivot along living hinge 15, thereby driving vane 17 downward and slightly outward. This then causes the plug 18 to be freed from the outlet 23, and the wall 19 to be freed from moat 26.

The lid may then automatically swing up to the FIG. 3 position (where in this embodiment the plastic is preferably biased as described above), or a consumer can manually move it to the FIG. 3 position. After this, the consumer can then push down on the actuator 21 in a conventional manner to dispense the shaving gel, shaving cream, or other product.

After the dispensing is completed, a consumer can then manually pivot the lid 12 down from the FIG. 3 position towards the FIG. 5 position, and then finally to the FIG. 4 position. Friction fit between the parts 18/19 and 23/26 will likely then hold the lid in a blocking/anti-drool position. However, if desired, and as noted above, the contact of projections 16 and 27 create a snap means to help retain the lid in such a blocking position. Also, optionally, a breakaway member (not shown) can be provided in front of the lid to provide assurance to a consumer that the product has not previously been used.

It should be appreciated from the above discussion that the FIGS. 1–5 lid will prevent drooling between uses. Further, the lid provides the consumer with an added sense of security that product in the container has not been tampered with prior to purchase. The plug can be readily and intuitively swung out of a blocking position by the consumer, and then easily swung back when the product has been dispensed. The cap is inexpensive to produce and adaptable to a wide variety of aerosol containers.

A preferred material for forming such caps is a shatter-resistant plastic such as a copolymer of polypropylene and polyethylene. It is preferred to form such caps by an injection molding process. However, other materials (plastic or otherwise) can be used to form over caps of the present invention, and the method of production is not critical.

Figure 6:
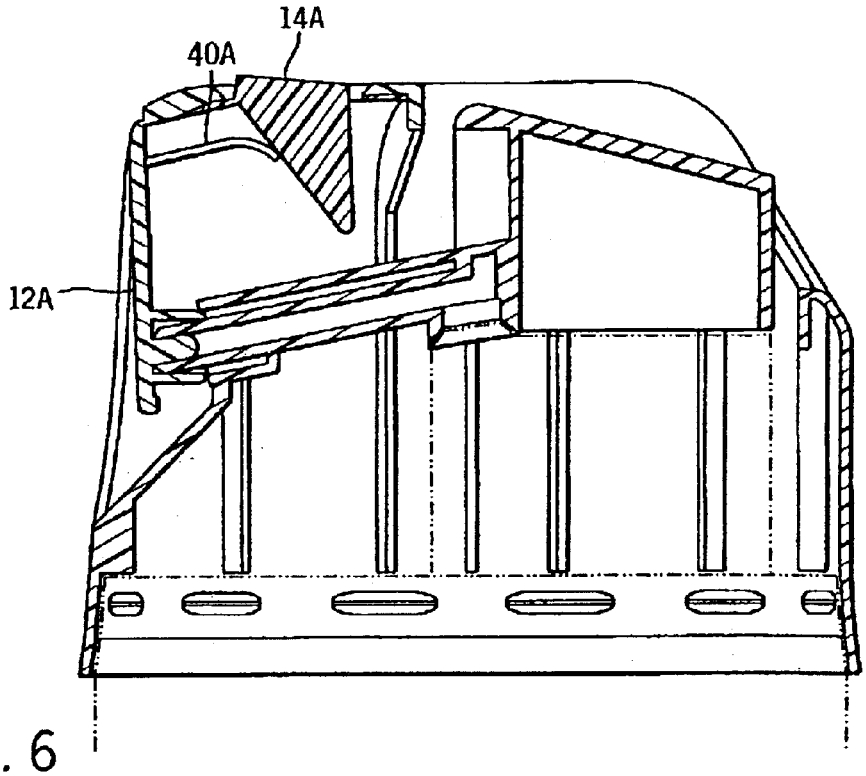
FIG. 6 is a view similar to FIG. 4, but of a second embodiment.
Figure 7:
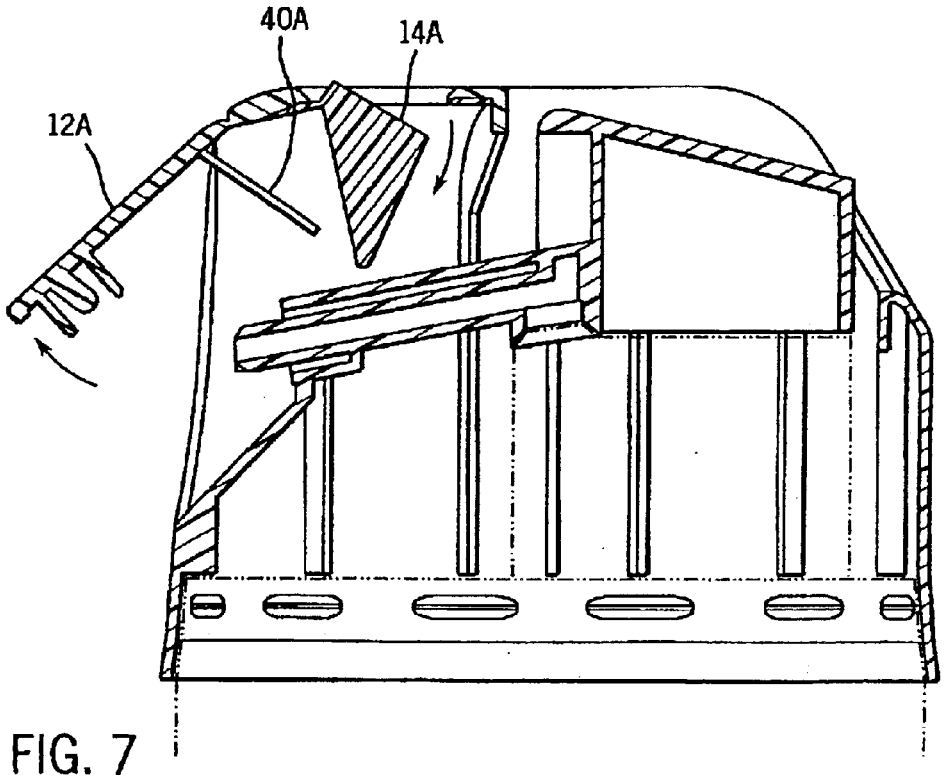
FIG. 7 is a view similar to FIG. 5, but of the second embodiment.

FIGS. 6 and 7 show a second embodiment of the over cap of the present invention. It is similar to the first embodiment with the exception of the way the driver interacts with the lid. In this embodiment, the lid is provided with a flexible leaf spring section 40A instead of a rigid protuberance (as at 17 in FIG. 4). The driver 14A pivots as before (with respect to driver 14), but now contacts the spring section 40A. The lid 12A is thereby caused to pop out as was the case with lid 12.

This assembly has the benefit of spring loading the lid when it is closed so that it will pop quickly up and out of the way once the button 14A is pushed, even if button 14A is not contacted with great or extended force. This helps avoid the lid swinging only slightly away from the outlet (compare FIG. 5), if the plastic at the joint where the lid is connected to the cap is not pre-biased properly.

Figure 8:
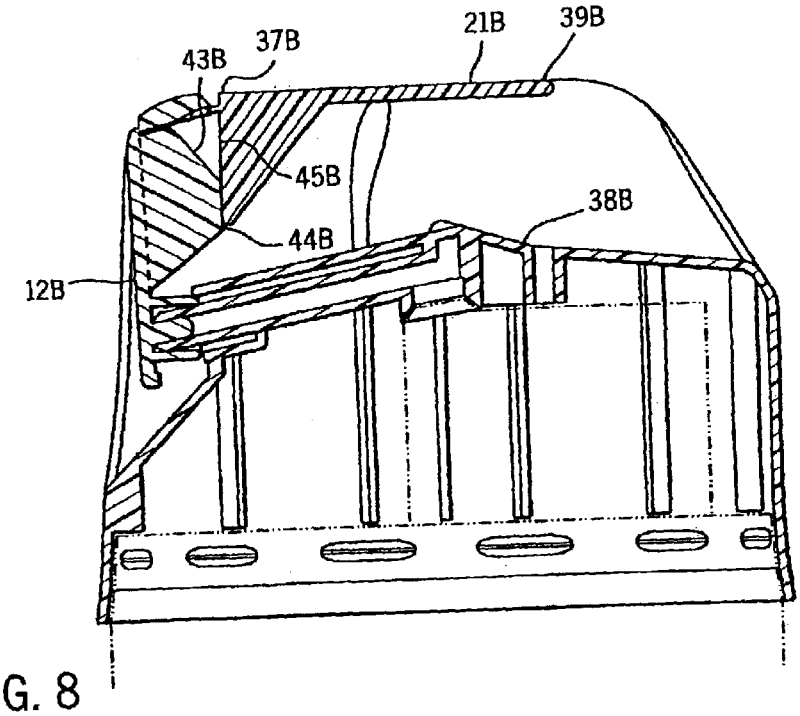
FIG. 8 is a view similar to FIG. 6, but of a third embodiment.
Figure 9:
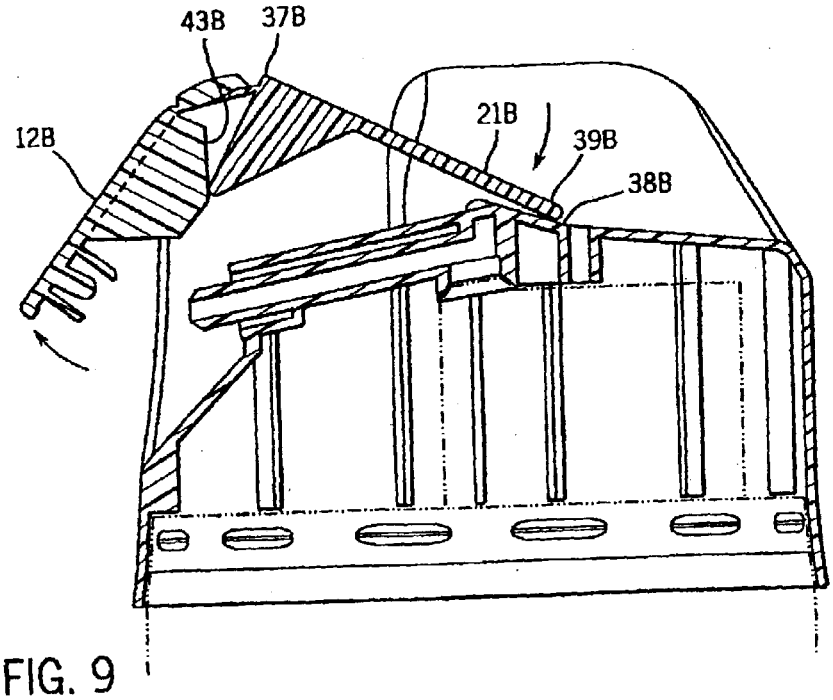
FIG. 9 is a view similar to FIG. 7, but of the third embodiment.

In FIGS. 8 and 9 there is shown a third embodiment in which the actuator 21B both triggers the dispensing and functions as a driver for popping the lid out. An inward end 39B of the actuator 21B can pivot down on an axis 37B to contact a pivotable receiver structure 38B, that in turn causes a dispensing. At the same time the driver end 45B of the actuator is caused to move against an abutment surface 44B to pop the lid 12B out. The driver 45B then holds the lid out by contact with abutment surface 43B.

Thus, a single downward push both pops the lid out and starts the dispensing. That is advantageous in some applications, albeit it is not optimal in others.

While preferred embodiments of the present invention have been disclosed above, it should be appreciated that other changes can be made to the concept that are within the claimed subject matter. For example, how the receiver interacts with the valve stem is not critical (e.g. downward or sideward movement, or a combination of the two).

Further, the outlet need not be on the side of the cap. The outlet could be at the top, with the actuator push button on the side. Also, instructions regarding how to use the driver can be printed on the driver (e.g. "Push"), or a symbol placed on the top of the driver could be used to communicate a similar message.

These and still other modifications are intended to be within the scope of the claimed subject matter.

INDUSTRIAL APPLICABILITY

The present invention provides over caps for aerosol containers which reduce the incidence of drool between uses, yet are easy to activate.

We claim:

1. An actuator cap suitable for use with a pressurized container, the container being of the type containing a product to be dispensed, the cap comprising:

a housing having a top wall and an outer skirt wall depending downward there from;

an actuator panel movably linked to a wall of the housing;

a receiver linked to the housing which is suitable for receiving product from the container, the receiver being in communication with an outlet of the cap;

a lid movably linked to the housing to move between a first position blocking the outlet and a second position not blocking the outlet; and a driver linked to a wall of the housing that can drive the lid away from the first position;

wherein the driver is linked by a hinge to a top wall of the cap.

2. The actuator cap of claim 1, wherein the driver is integrally formed with the actuator panel and pivots there with.

3. The actuator cap of claim 1, wherein the actuator panel is mounted for pivoting on an essentially horizontal axis such that when the actuator is pivoted downwardly the lid will be pivoted outwardly.

4. An actuator cap suitable for use with a pressurized container, the container being of the type containing a product to be dispensed, the cap comprising:

a housing having a top wall and an outer skirt wall depending downward there from;

an actuator panel movably linked to a wall of the housing;

a receiver linked to the housing which is suitable for receiving product from the container, the receiver being in communication with an outlet of the cap;

a lid movably linked to the housing to move between a first position blocking the outlet and a second position not blocking the outlet; and a driver linked to a wall of the housing that can drive the lid away from the first position;

wherein the receiver is integrally formed with the actuator panel and pivots there with.

5. An actuator cap suitable for use with a pressurized container, the container being of the type containing a product to be dispensed, the cap comprising:

a housing having a top wall and an outer skirt wall depending downward there from;

an actuator panel movably linked to a wall of the housing;

a receiver linked to the housing which is suitable for receiving product from the container, the receiver being in communication with an outlet of the cap;

a lid movably linked to the housing to move between a first position blocking the outlet and a second position not blocking the outlet; and a driver linked to a wall of the housing that can drive the lid away from the first position;

wherein the actuator panel projects through the top wall of the cap.

6. The actuator cap of claim 5, wherein the receiver has an axial conduit portion and a radial conduit portion.

7. The actuator cap of claim 5, wherein the lid is pivotably linked to the housing along an essentially horizontal hinge axis.

8. The actuator cap of claim 5, wherein the driver is in the form of a button.

9. The actuator cap of claim 8, wherein the button is pivotably linked to a top wall of the cap along an essentially horizontal hinge axis.

10. The actuator cap of claim 9, wherein the button is positioned relative to the lid such that when the lid is in the first position pivoting movement of the button can move the lid away from the first position.

11. An actuator cap suitable for use with a pressurized container, the container being of the type containing a product to be dispensed, the cap comprising:

a housing having a top wall and an outer skirt wall depending downward there from;

an actuator panel movably linked to a wall of the housing;

a receiver linked to the housing which is suitable for receiving product from the container, the receiver being in communication with an outlet of the cap;

a lid movably linked to the housing to move between a first position blocking the outlet and a second position not blocking the outlet; and a driver linked to a wall of the housing that can drive the lid away from the first position;

wherein the lid is pivotably linked to the housing along an essentially horizontal hinge axis; and wherein the lid has a vane extending transversely there from adjacent its inward end, and a plug extending transversely there from adjacent its outer end.

12. The actuator cap of claim 11, wherein the plug is surrounded by a extension extending transversely there from adjacent an outer end of the lid.

13. The actuator cap of claim 11, wherein the vane has a first abutment surface that is generally parallel to the lid, and a second abutment surface that is not generally parallel to the lid.

14. An actuator cap suitable for use with a pressurized container, the container being of the type containing a product to be dispensed, the cap comprising:

a housing having a top wall and an outer skirt wall depending downward there from;

an actuator panel movably linked to a wall of the housing;

a receiver linked to the housing which is suitable for receiving product from the container, the receiver being in communication with an outlet of the cap;

a lid movably linked to the housing to move between a first position blocking the outlet and a second position not blocking the outlet; and a driver linked to a wall of the housing that can drive the lid away from the first position;

wherein the outlet is surrounded by a moat, which in turn is surrounded by a tubular structure.

15. An actuator cap suitable for use with a pressurized container, the container being of the type containing a product to be dispensed, the cap comprising:

a housing having a top wall and an outer skirt wall depending downward there from;

an actuator panel movably linked to a wall of the housing;

a receiver linked to the housing which is suitable for receiving product from the container, the receiver being in communication with an outlet of the cap;

a lid movably linked to the housing to move between a first position blocking the outlet and a second position not blocking the outlet; and a driver linked to a wall of the housing that can drive the lid away from the first position;

wherein snap means are provided between the lid and the cap to help retain the cap in the first position.

* * * * *